US005142772A

United States Patent [19]

Ishikawa

[11] Patent Number: 5,142,772

[45] Date of Patent: Sep. 1, 1992

[54] APPARATUS FOR MANUFACTURING SLIDE FASTENERS EACH HAVING A SELECTED NUMBER OF SLIDERS

[75] Inventor: Kiichiro Ishikawa, Marietta, Ga.

[73] Assignee: Yoshida Kogyo K.K., Tokyo, Japan

[21] Appl. No.: 756,338

[22] Filed: Sep. 6, 1991

[51] Int. Cl.[5] ..... A41H 37/06

[52] U.S. Cl. ..... 29/768; 29/408

[58] Field of Search ..... 29/766, 768, 408, 409, 29/33.2

[56] References Cited

U.S. PATENT DOCUMENTS 3,626,579 12/1971 Maeda .
4,625,398 12/1986 Kando ..... 29/768
4,727,210 5/1988 Suzuki .
4,771,522 9/1988 Osaki .
4,782,587 11/1988 Yunoki .
4,809,414 3/1989 Sawada .
4,974,315 12/1990 Yunoki .

*Primary Examiner*—P. W. Echols

*Attorney, Agent, or Firm*—Hill, Van Santen, Steadman & Simpson

[57] ABSTRACT

An apparatus for manufacturing slide fasteners of a predetermined length from a continuous slide fastener chain comprising a gripper unit for gripping a leading end of the continuous slide fastener chain and feeding the slide fastener chain longitudinally along a feed path, a cutter unit for cutting the slide fastener chain into a succession of slide fasteners of a predetermined length, and a plurality of slider holding units disposed downstream of the cutter unit along the feed path. The slider holding units are movable between a first position to hold a corresponding number of sliders in the feed path of the slide fastener chain to thread the sliders onto the slide fastener chain from the leading end thereof as the slide fastener chain is fed downstream by the gripper unit, and a second position remote from the first position. Each of the slider holding units is operative independent of the operation of another slider holding unit so that one or more sliders can selectively be threaded on the slide fastener chain by holding a desired number of the slide holding units in the first position.

11 Claims, 9 Drawing Sheets

APPARATUS FOR MANUFACTURING SLIDE FASTENERS EACH HAVING A SELECTED NUMBER OF SLIDERS

BACKGROUND OF THE INVENTION

1. Field of the Invention:

The present invention relates to an apparatus for automatically manufacturing slide fasteners of a predetermined length from a continuous slide fastener chain with one or more sliders mounted on each slide fastener.

2. Description of the Prior Art:

Various apparatus for manufacturing slide fasteners of a predetermined length successively from a continuous slide fastener chain are known in the art. In one such known apparatus disclosed in U.S. Pat. No. 4,771,522, one slider is threaded over a continuous slide fastener chain from the leading end thereof before a predetermined slide-fastener length of the slide fastener chain is cut. According to another known apparatus disclosed in U.S. Pat. No. 4,809,414, two sliders are successively threaded over a continuous slide fastener chain from the leading end thereof before a predetermined slide-fastener length of the slide fastener chain is severed.

Since the known apparatus have a construction exclusive to the manufacture of slide fasteners having either one or two sliders, they are almost impossible to meet the desire for slide fasteners each having one or more sliders which are selected at option by the consumers or the apparel makers.

SUMMARY OF THE INVENTION

With the foregoing difficulties in view, it is an object of the present invention to provide an apparatus for automatically manufacturing slide fasteners of a predetermined length successively from a continuous slide fastener chain, with a desired number of sliders threaded over each individual side fastener.

According to the present invention, there is provided an apparatus for manufacturing slide fasteners of a predetermined length from a continuous slide fastener chain, with a selected number of sliders threaded over each individual slide fastener. The apparatus comprises a horizontally reciprocable gripper unit for gripping a leading end of the continuous slide fastener chain and feeding the slide fastener chain longitudinally along a feed path, a cutter unit disposed on the feed path for cutting the slide fastener chain into a succession of slide fasteners of a predetermined length, and a plurality of slider holding units disposed downstream of the cutter unit along the feed path of the slide fastener chain and movable between a first position to hold a corresponding number of sliders in the feed path of the slide fastener chain to thread the sliders onto the slide fastener chain from the leading end thereof as the slide fastener chain is fed downstream by the gripper unit, and a second position remote from the first position. Each of the slider holding units is operative independent of the operation of another slider holding unit so that at least a selected one of the slider holding units can be disposed in the first position to thread the corresponding slider onto the slide fastener chain.

The above and other objects, features and advantages of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

The present invention will be described hereinbelow in greater detail with reference to a preferred embodiment shown in the accompanying drawings.

Figure 1:
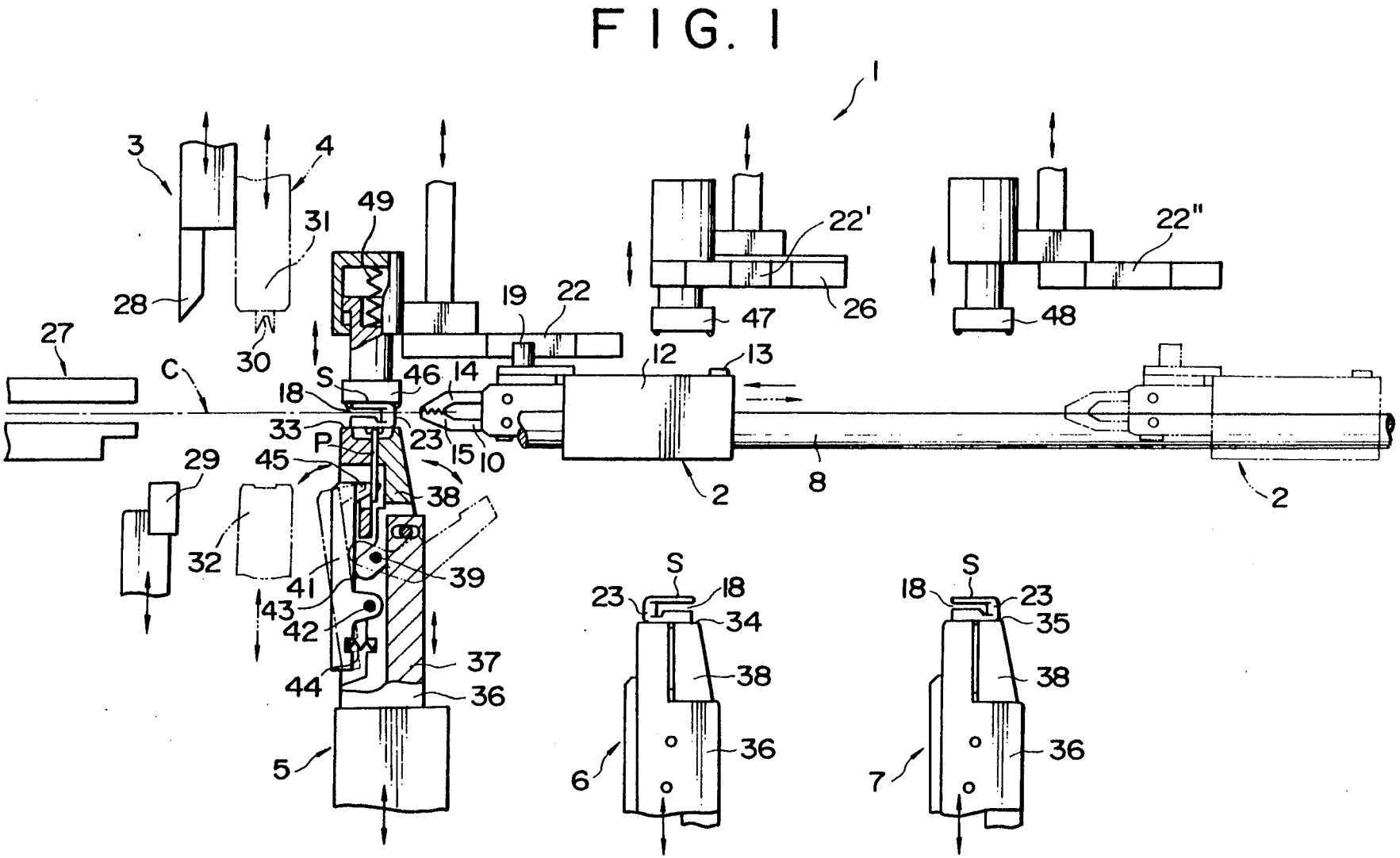
FIG. 1 is a diagrammatical side view, with parts cutaway for clarity, of a slide fastener manufacturing apparatus according to the present invention.

FIG. 1 shows the general construction of an apparatus 1 of the invention for manufacturing slide fasteners of a predetermined length successively from a continuous slide fastener chain C.

The apparatus 1 generally comprises a gripper unit 2, a cutter unit 3, a bottom-stop attaching unit 4, and a plurality (three in the illustrated embodiment) of slider holding units 5, 6 and 7.

Figure 2:
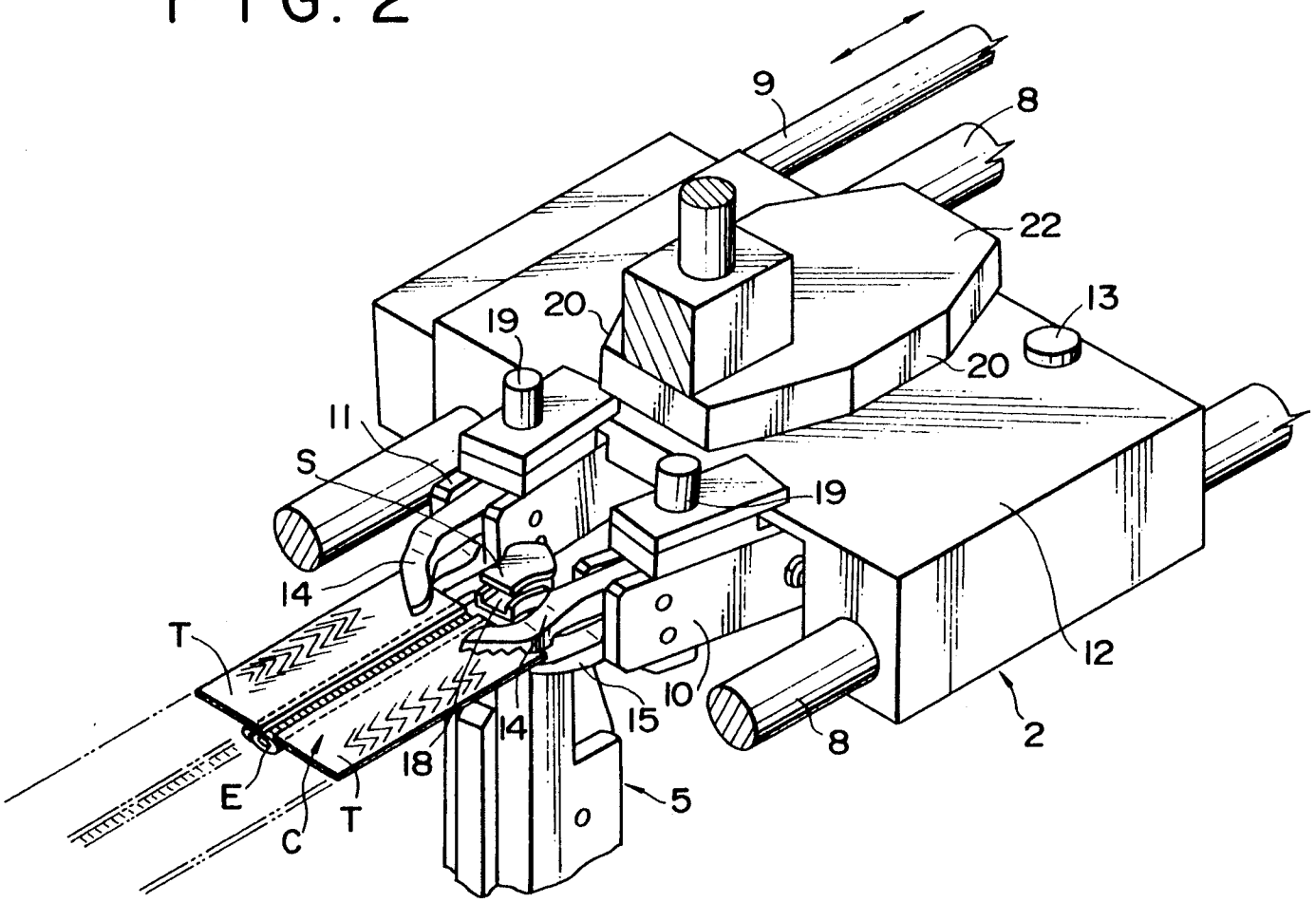
FIG. 2 is a perspective view showing a gripper unit of the apparatus and related parts thereof.

The gripper unit 2 is constructed to grip a leading end of the slide fastener chain C at an upstream end of the apparatus 1 and feed the slide fastener chain C downstream along a longitudinal feed path for threading the slide fastener chain C through at least one slider S while the slider S is being held by the corresponding slider holding unit 5, 6 or 7. As shown in FIG. 2, the gripper unit 2 is slidably mounted on a pair of parallel spaced guide rods 8, 8 extending parallel to the feed path of the slide fastener chain C and is reciprocable on and along the guide rods 8, 8 in response to the reciprocating movement of a drive rod 9 connected to a fluid-pressure actuator such as an air cylinder (not shown). The gripper unit 2 has at its upstream end a pair of grippers 10, 11 for gripping respective leading ends of a pair of stringer tapes T, T of the slide fastener chain C. The two grippers 10, 11 are pivotally connected at respective downstream ends to a lower side of a support plate 12 by a pair of vertical pivot pins 13, 13 (best shown in FIG. 3(*a*)), respectively. The support plate 12 is mounted astride the guide rods 8. The two grippers 10, 11 are identical in construction and are symmetrical with respect to a vertical plane extending centrally along the feed path of the slide fastener chain C. With this construction, respective upstream ends (front ends) of the grippers 10, 11 are movable toward and away from each other in response to the pivotal movement of the grippers 10, 11. This relative movement of the two grippers 10, 11 enables a smooth threading of the slide fastener chain C through the slider S, as described later. Each of the grippers 10, 11 has at its upstream end upper and lower grip members 14, 15 pivotally movable in response to the reciprocating movement of a fluid-pressure actuator such as an air cylinder (not shown) acting on respective downstream ends of the grip members 14, 15 in such a manner that the upper and lower grip members 14, 15 are closed and opened at their upstream ends to grip and release the leading ends of the stringer tapes T of the slide fastener chain C. The upper and lower grip members 14, 15 are normally opened.

Figure 3A:
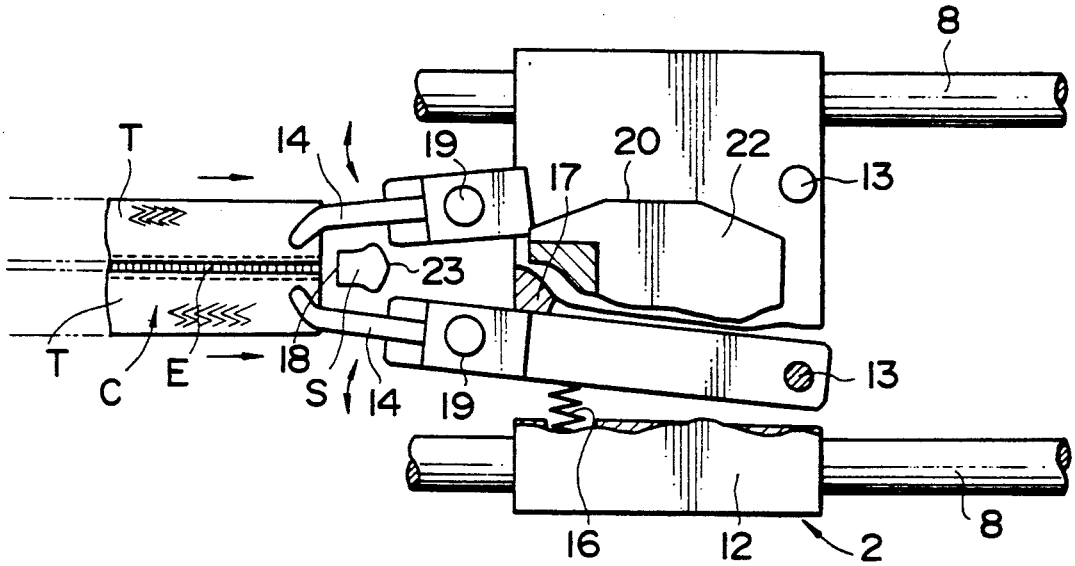
FIGS. 3(*a*), 3(*b*) and 4(*a*) through 4(*c*) are schematic plan views illustrative of the manner in which one slider is threaded over a slide fastener chain as the latter is fed by the gripper unit.
Figure 3B:
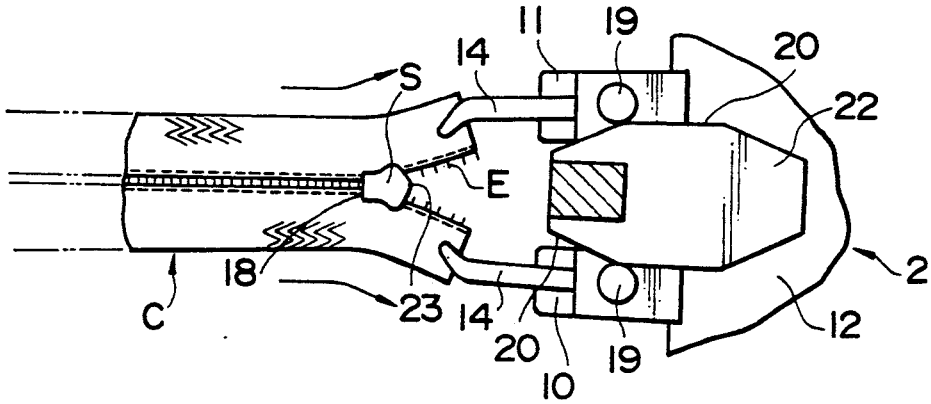

The pivotal movement of the two grippers 10, 11 will be described below in greater detail. As shown in FIG. 3(*a*), a compression coil spring 16 acts between an inner side wall of the support plate 12 and an intermediate portion of each of the grippers 10, 11 to urge the gripper 10, 11 to turn about the pin 13 in a direction such that an upstream end of one gripper 10, 11 is moved inwardly toward an upstream end of the opposite gripper 11, 10. The inward movement of the grippers 10, 11 is limited by a stopper 17 attached to a central portion of the lower side of the support plate 12. In this instance, the grippers 10, 11 are laterally spaced such that the upper and lower grip members 14, 15 of the respective grippers 10, 11 grip respective portions of the leading ends of the stringer tapes T, T adjacent to a pair of interengaged rows of coupling elements E of the slide fastener chain C. With this arrangement, the leading end of the slide fastener chain C is gripped stably by the gripper unit 2 after the slide fastener chain C has been supplied to the upstream end of the apparatus 1.

A description given below is directed to the operation of the gripper unit 2 which is performed when a slider S held on a slider holding unit 5 such as shown in FIG. 2 is threaded onto the slide fastener chain C. In this instance, the slider S is held with its tail 18 facing upstream of the feed path of the slide fastener chain C so that the slider S is threaded onto the slide fastener chain C with the tail 18 directed forward. The tail 18 of the slider S includes one end of a Y-shaped guide channel defined in a slider body from which the interengaged rows of coupling elements E are moved into and out of the slider S. The slider S also has a head 23 located opposite to the tail 18 and including the opposite end of the Y-shaped guide channel from which the disengaged rows of coupling elements E are moved into and out of the slider S. As shown in FIGS. 3(*a*) and 3(*b*), the leading end of the slide fastener chain C gripped by the gripper unit 2 is first threaded from the tail 18 into the slider body and then progressively spread by the slider S into a Y shape as the coupling elements E advance along the Y-shaped guide channel in the slider body. To this end, the grippers 10, 11 have near their upstream ends a pair of guide pins 19, 19 each mounted on the top of the respective gripper 10, 11. The two guide pins 19, 19 are engageable with a pair of cam surfaces 20, 20 at opposite sides of an elongate cam plate 22 vertically movable into and out of a path of movement of the gripper unit 2. The cam plate 22 is tapered at opposite ends (upstream and downstream ends) and the two cam surfaces 20, 20 are symmetrical with each other about a vertical plane extending centrally along the path of movement of the gripper unit 2. The cam plate 22 shown in FIG. 2 is disposed in its lowermost operating position close to the path of movement of the gripper unit 2. In this condition, when the gripper unit 2 is moved downstream along the feed path of the slide fastener chain C, the guide pins 19, 19 roll on the cam surfaces 20, 20 of the cam plate 22, causing the two grippers 10, 11 to pivotally move about the respective pivot pins 13, 13 so that the upstream ends of the grippers 10, 11 are temporarily moved away from each other against the bias of the compression coil springs 16, as shown in FIG. 3(*b*). Thus, the two grippers 10, 11 are capable of spreading apart to cope with the condition wherein, as the slide fastener chain C is fed downstream by the gripper unit 2, the leading end of the slide fastener chain C gripped by the gripper unit 2 is first threaded from the tail 18 into the slider body, then progressively spread by the slider S into a Y shape, and finally goes out from the head 23 of the slider body.

Figure 4A:
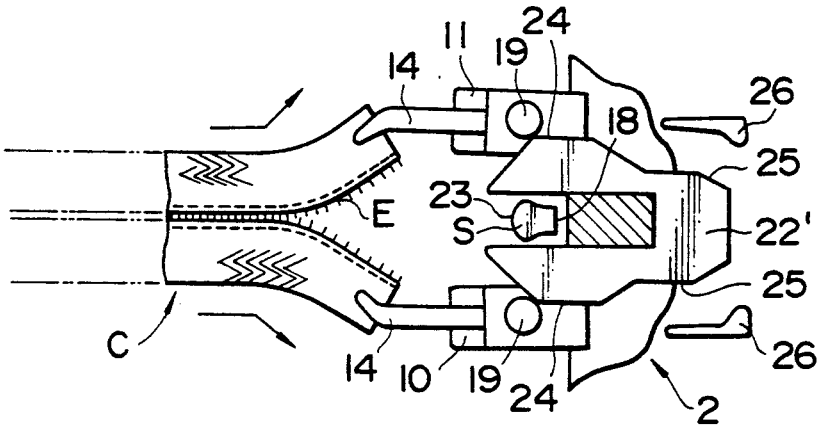
Figure 4B:
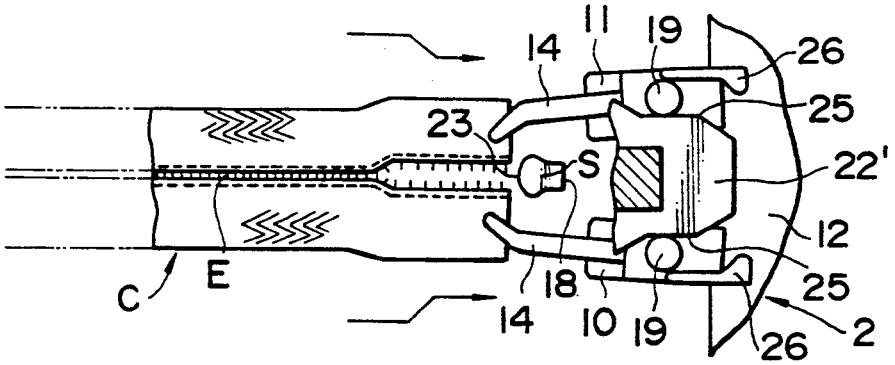
Figure 4C:
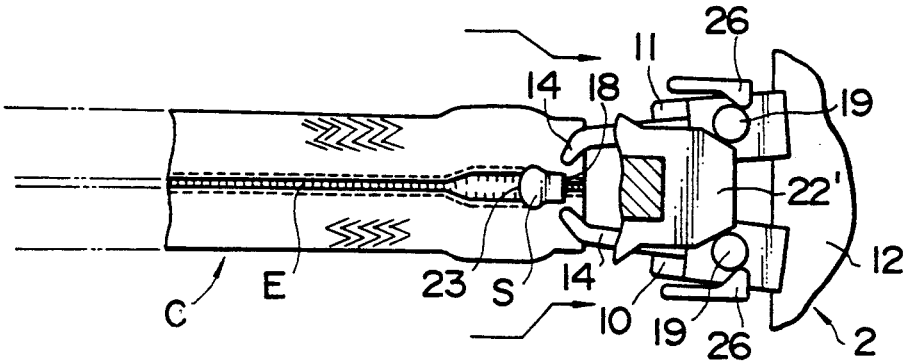

The leading end of the slide fastener chain C can be threaded into the slider S from the head 23 as the slide fastener chain C is fed downstream by the gripper unit 2. In this instance, the two grippers 10, 11 must be movable to cope with the condition wherein, as the slide fastener chain C is fed downstream by the gripper unit 2, the leading end of the slide fastener chain C is spread laterally to separate the initially interengaged rows of coupling elements E as shown in FIG. 4(*a*), then disengaged rows of coupling elements E are spaced parallel before they move into the body of the slider S from head 23 side of the slider S as shown in FIG. 4(*b*), and finally the laterally spread leading end of the slide fastener chain C is closed again as the disengaged rows of coupling elements E are coupled together within the body of the slider S as shown in FIG. 4(*c*). To insure the foregoing movement of the grippers 10, 11, there is provided a second elongate cam plate 22'. The second elongate cam plate 22' has a pair of laterally spaced first cam surfaces 24, 24 at an upstream side and a pair of laterally spaced second cam surfaces 25, 25 at the downstream side. The first cam surfaces 24, 24 are substantially the same as the cam surfaces 20, 20 of the first-mentioned cam plate 22 shown in FIGS. 2 and 3(*b*). The second cam surfaces 25, 25 include a pair of parallel spaced portions contiguous to respective downstream ends of the first cam surfaces 24, 24 and extending parallel to the path of movement of the gripper unit 2, and a pair of downstream tapered portions contiguous to respective downstream ends of the parallel spaced portions. In order to facilitate the re-engagement of the disengaged rows of coupling elements E within the body of the slider S, it is preferable to provide a pair of auxiliary cam plates 26, 26 on opposite sides of the second cam plate 22' adjacent to the downstream end thereof. The auxiliary cam plates 26, 26 are integral with the second cam plate 22' and engageable with the guide pins 19, 19 to urge them against the second cam surfaces 25 of the second cam plate 22'. The second cam plate 22' is disposed above the path of movement of the gripper unit 2 and vertically movable between a lowermost operating position close to the path of movement of the gripper unit 2 and an uppermost standby position remote from the path of movement of the gripper unit 2.

Figure 5:
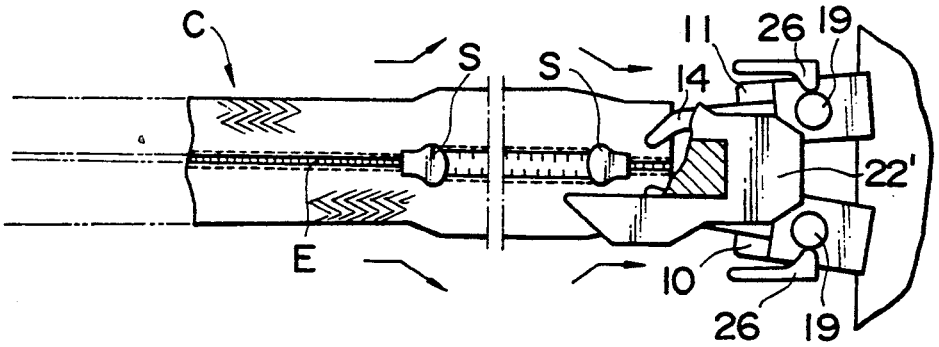
FIG. 5 is a schematic plan view showing the manner in which two sliders are threaded over the slider fastener chain as the latter is fed by the gripper unit.
Figure 9:
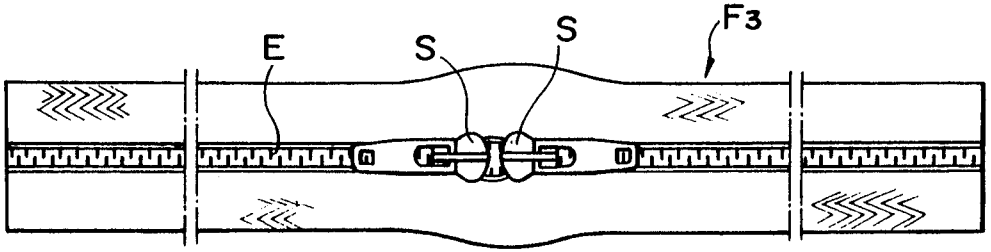

The first and second cam plates 22, 22' may be disposed along the path of movement of the gripper unit 2 in that order so that, when two sliders S, S and held in head-to-head confronting relation as shown in FIG. 5, the movement of the gripper unit 2 in the downstream direction to feed the slide fastener chain C causes the leading end of the slide fastener chain C to thread successively through the two sliders S, S, thereby enabling the formation of a slide fastener F2 shown in FIG. 9. In FIG. 5, the first cam plate 22 is omitted for purposes of illustration but it is disposed in a position where the first slider S (left-hand slider in this figure) is threaded onto the slide fastener chain C.

Referring back to FIG. 1, the cutter unit 3 for cutting the slide fastener chain C into a predetermined slide-fastener length is disposed at the upstream end of the apparatus 1 adjacent to a supply end of a chain guide 27 from which the slide fastener chain C is supplied to the apparatus 1. The cutter unit 3 includes an upper cutter 28 disposed above the feed path of the slide fastener chain C, and a lower cutter 29 disposed below the feed path of the slide fastener chain C. The upper and lower cutters 28, 29 are vertically movable toward and away from each other to cut the slide fastener chain C. A drive mechanism for driving the cutter unit 3 and the manner in which the slide fastener chain C is cut by the cutter unit 3 are well known in the art and, hence, a further description is no longer needed. The cutter unit 3 composed of relatively movable upper and lower cutters 28, 29 may be replaced with a ultrasonic cutter composed of a ultrasonic horn and an anvil.

The bottom-stop attaching unit 4 is disposed in the feed path of the slide fastener chain C immediately downstream of the cutter unit 3. The bottom-stop attaching unit 4 includes a punch 31 disposed above the feed path of the slide fastener chain C for holding a bottom stop 30 at its lower end, and a die 32 disposed below the feed path of the slide fastener chain C. The punch 31 and the die 32 are vertically movable toward and away from each other to attach the bottom stop 30 to the slide fastener chain C in the course of the production of a slide fastener F7 shown in FIG. 13. When slide fasteners devoid of the bottom stop 30 are to be produced, the bottom-stop attaching unit 4 can be omitted. The structural details and the operation of the bottom-stop attaching unit 4 are known per se and, hence, a further description is not needed any more.

Figure 6:
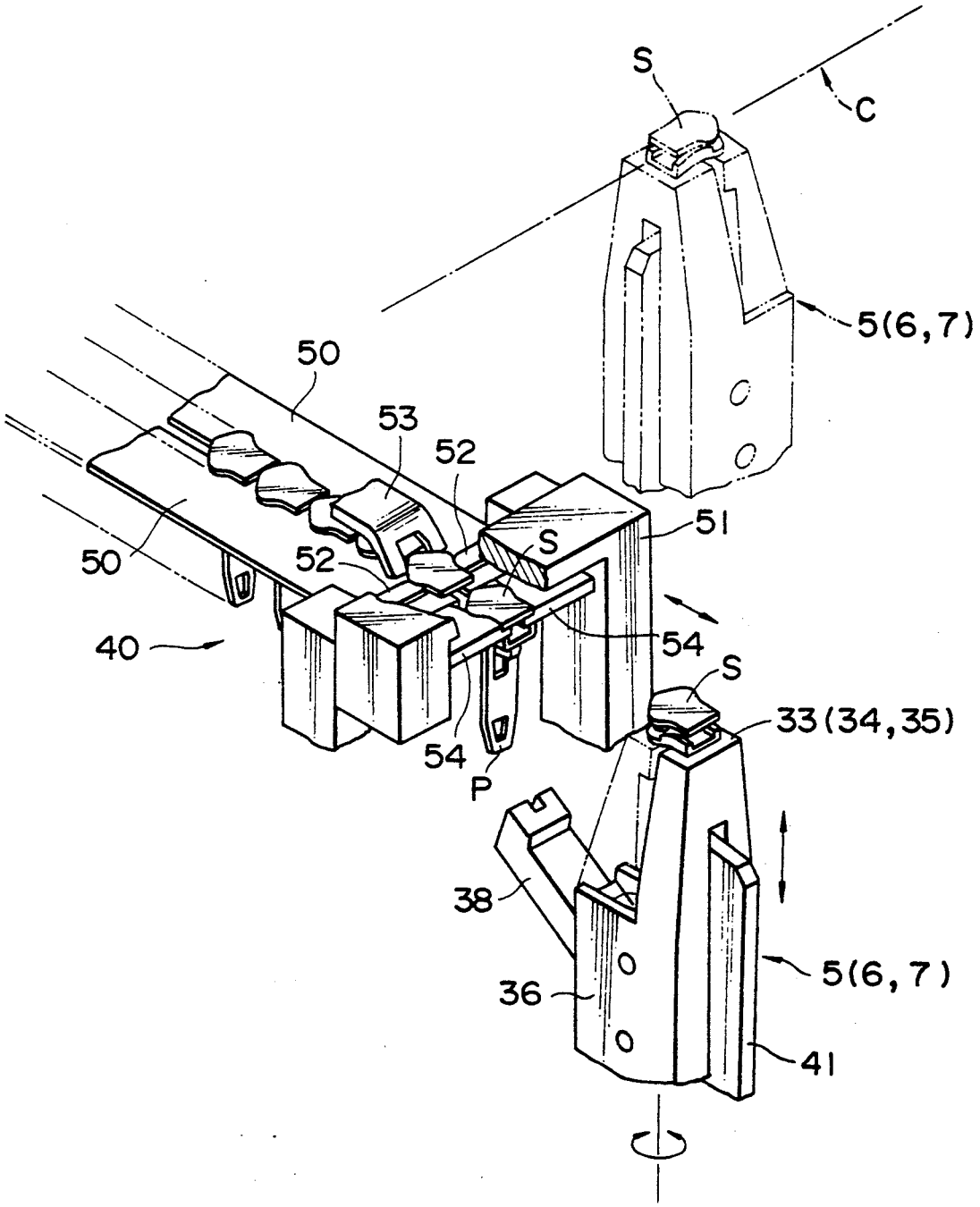
FIG. 6 is a fragmentary perspective view of a slider holding unit and a slider supply unit of the apparatus.

The first, second and third slide holding units 5, 6, 7 are disposed downstream of the bottom-stop attaching unit 4 along the feed path of the slide fastener chain C, as shown in FIG. 1. The slide holding units 5, 6, 7 have at their top respective slider supporting surfaces 33, 34, 35 for supporting the sliders S, respectively, while the sliders S held by the slider holding units 5, 6, 7 are threaded onto the slide fastener chain C as the latter is fed by the gripper unit 2 downstream along the feed path. The first, second and third slider holding units 5, 6, 7 are substantially identical in construction and, therfore, the following is a detailed description of the first slider holding unit 5, with the description of other slider holding units 6, 7 omitted. The slider holding unit 5 includes an upright box-like holder body 36 disposed below the feed path of the slide fastener chain C, an actuating bar 37 vertically movably received in the holder body 36, and a retaining arm 38 linked with an upper end of the actuating bar 37 and pivotally connected to the holder body 36 by a horizontal pivot pin 39. When the actuating bar 37 is lowered by a fluid-actuated actuator such as an air cylinder (not shown), the retaining arm 38 is pivotally moved about the pivot pin 39 from an upright position indicated by solid lines to an inclined position indicated by phantom lines. When the actuating bar 37 is raised, the retaining arm 38 returns from the inclined position to the original upright position. In this upright position, the retaining arm 38 cooperates with the holder body 36 to grip a pull tab P of the slide fastener S whose body is held on the supporting surface 33 (34, 35). When the retaining arm 38 is disposed in the inclined position, the slider S can be removed from the slider supporting surface 33 (34, 35), or alternatively, a slider S is supplied to the slider supporting surface 33 (34, 35) via a slider supply unit 40 (FIG. 6). The slider holding unit 5 (6, 7) also includes a clamp 41 connected by a horizontal pivot pin 42 to the holder body 36 and held in contact with an arcuate cam 43 formed at a lower end of the retaining arm 38. The clamp 41 is urged to turn clockwise about the pivot pin 39 by the force of a compression coil spring 44 acting between a lower end portion of the clamp 41 and the holder body 36. The clamp 41 has at its top a rearwardly directed locking projection 45 receivable in an hole in the slider pull tab P. With this construction, when the retaining arm 38 is tilted from the solid-lined upright position to the phantom-lined inclined position, the clamp 41 is pivotally moved about the pivot pin 42 against the bias of the spring 44 from an upright position indicated by solid lines to an inclined position indicated by phantom lines. In this inclined position, the locking prong 45 is disengaged from the hole in the slider pull tab P. When the retaining arm 38 returns from the inclined position to the original upstanding position, the clamp 41 is returned from the phantom-lined inclined position to the original upright position by the force of the spring 44. In this upright position, the locking prong 45 fits into the hole in the slider pull tab P to lock the slider S on the slider supporting surface 33 (34, 35) of the slider holding unit 5 (6, 7).

The first, second and third slider holding units 5, 6, 7 are vertically movable between an uppermost operation position in which the sliders S held on the respective slider supporting surfaces 33, 34, 35 are disposed in the feed path of the slide fastener chain C and thereby threaded onto the slide fastener chain C, and a lowermost standby position remote from the operating position. The movement of one slider holding unit 5, 6 or 7 is independent of the movement of another slider holding unit. The slider holding units 5, 6, 7 are driven by three fluid-pressure actuators (not shown), respectively.

In the illustrated embodiment, the first, second and third slider holding units 5, 6, 7 support, on their slider supporting surfaces 33, 34, 35, three sliders S in such a manner that adjacent two sliders S are disposed either in head-to-head confronting relation or in tail-to-tail confronting relation. More specifically, the sliders S held on the first and second slider holding units 5, 6 are disposed in head-to-head confronting relation, while the sliders S held on the second and third slider holding units 6, 7 are disposed in tail-to-tail confronting relation.

First, second and third slider pressers 46, 47, 48 are disposed directly above the first, second and third slider holding units 5, 6, 7, respectively, and vertically movable toward and away from the corresponding slider holding units 5, 6, 7 in response to the action of respective fluid-pressure actuators such as air cylinders (not shown). Likewise the slider holding units 5, 6, 7, the first, second and third slider pressers 46, 47, 48 are movable independently but are driven in interlocking relation to the operation of the confronting slider holding units 5, 6, 7. In other words, when the first slider holding unit 5 is raised to its uppermost operating position while the second and third slider holding units 6, 7 are held in the lowermost standby position, such as shown in FIG. 1, the first slider presser 46 is lowered to its lowermost operating position to force the slider S against the slider supporting surface 33. Thus, the slider S is firmly locked in position against wobbling during the course of the threading operation of the slide fastener chain 1 relative to the slider S. The three slider pressers 46, 47, 48 are identical in construction. Each of the slider pressers 46, 47, 48 is biased by a compression coil spring 49 and hence is able to force the slider S downward against the supporting surface 33, 34, 35 of the slider holding unit 5, 6, 7 without damaging the slider S. As shown in FIG. 1, the first slider presser 46 is integral with the first cam plate 22, the second slider presser 47 is integral with the second cam plate 22', and the third slider presser 48 is integral with a third cam plate 22" which is identical in construction to the first cam plate 22. The first, second and third slider pressers 46, 47, 48 are linked in operation with the first, second and third slider holding units 5, 6, 7, respectively, so that when the first slider holding unit 5 is raised, for example, the corresponding first slider presser 46 is lowered together with the first cam plate 22.

The gripper unit 2, the bottom-stop attaching unit 4, the plural (first to third) slider holding units 5, 6, 7, the slider pressers 46, 47, 48, and the cam plates 22, 22', 22" are linked in operation with each other and controlled by a control unit (not shown) in accordance with a production control program stored in the control unit so as to produce a desired number of slide fasteners of a predetermined product length, with a desired number of sliders mounted on each slide fastener.

As shown in FIG. 6, the slider supply unit 40 is associated with each of the first, second and third slider holding units 5, 6, 7 for automatically supplying a slider S onto the slider supporting surface 33, 34, 35 of the corresponding slider holding unit 5, 6, 7 from a direction perpendicular to the feed path of the slider fastener chain C when the slider holding unit 5, 6, 7 is disposed in the lowermost standby position. In the lowermost standby position, the slider holding unit 5, 6, 7 is rotatable about a vertical axis through an angle of 90 degrees so that direction of the slider supporting surface 33, 34, 35 is aligned with the direction of supply of the slider S from the slider supply unit 40. In this instance, the retaining arm 38 is disposed in the inclined position. The slider supply unit 40 includes a slider chute 50 connected at its upstream end to a parts feeder (not shown) for guiding a succession of sliders S downstream along a path with their pull tabs P depending vertically, and a slider feed device 51 movable between a downstream end of the slider chute 50 and the slider holding unit 5, 6, 7 for transferring the slider S from the slider chute 50 onto the slider supporting surface 33, 34, 35 of the slider holding unit 5, 6, 7. The sliders S fed along the slider chute 50 of each slider supply unit 40 are oriented to conform to a final orientation realized when they are threaded on the slide fastener chain C. A pair of confronting stoppers 52 is disposed at the downstream end of the slider chute 50 and movable transverse to the direction of movement of the slider S along the slider chute 51 for stopping a leading slider S. The stoppers 52 are urged toward each other by means of a pair of compression springs (not shown), respectively. The slider supply unit 40 further includes a feed finger 53 disposed adjacent to the downstream end of the slider chute 50. The feed finger 53 is pivotally movable between a supply position to feed the leading slider S between a pair of confronting grip fingers 54, 54 of the slider feed device 51, and a standby position ready to feed the next following slider S. The grip fingers 54, 54 are urged toward each other by a pair of compression coil springs (not shown), respectively, so that they can hold the slider S which has been supplied from the slider chute 50 by the feed finger 53. The slider feed device 51 with the slider S held between the grip fingers 54, 54 is moved toward the slider holding unit 5, 6, 7 to transfer the slider S onto the slider supporting surface 33, 34, 35. Then, the retaining arm 38 is pivoted to the upright position to grip the slider pull tab P between itself and the holder body 36. Simultaneously therewith, the slider pull tab P is locked in position by the clamp 41. After the slider feed device 51 is returned to its original position adjacent to the slider chute 50, the slider holding unit 5, 6, 7 is turned through an angle of 90 degrees. Subsequently, the slider holding unit 5, 6, 7 is raised to the uppermost operating position indicated by phantom lines to hold the slider S in the feed path of the slide fastener chain C. The slider supply unit 40 is known per se and, hence, a further description is no longer needed.

Thus, the sliders S are automatically supplied to the slider holding units 5, 6, 7. Then, the sliders S held by the respective slider holding units 5, 6, 7 can automatically be threaded onto the slider fastener chain C by the coaction of the slider holding units 5, 6, 7, the cam plates 22, 22', 22" and the gripper unit 2. By selectively actuating sets of the slider holding units 5, 6, 7 and the cam plates 22, 22', 22", it is possible to produce slide fasteners of a predetermined length, with a given number of sliders mounted on each of the slide fasteners.

FIGS. 7 through 14 show various slide fasteners F1–F8 which are produced by the apparatus 1 of the present invention shown in FIG. 1.

Figure 7:
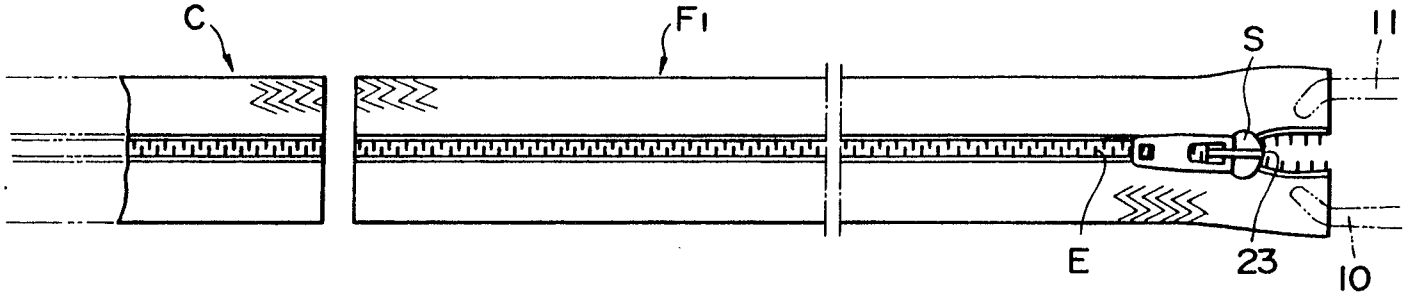
FIGS. 7 through 14 are fragmentary plan views showing various slide fasteners manufactured by the apparatus.

When the slide fastener F1 shown in FIG. 7 is to be produced, one of the first and third slider holding units 5 and 7 is raised in the uppermost operating position to hold a slider S in the feed path of the slide fastener chain C, while the remaining slider holding units 7 or 5 and 6 are disposed in the lowermost standby position. At the same time, the slider presser 46 or 48 and the associated cam plate 22 or 22" are lowered to their respective lowermost operating positions. Then the slide fastener chain C which has been gripped at its leading end by the gripper unit 2 at a position adjacent to the chain guide 27 is moved downstream along the feed path by the gripper unit 2, thereby threading the slider S onto the slide fastener chain C. After the slide fastener chain C is fed by a predetermined distance, the gripper unit 2 is stopped and then the cutter unit 3 is actuated to cut the slide fastener chain C, thereby producing a slide fastener F1 of a prdetermined length. The slide fastener F1 thus produced has a single slider S mounted with its head 23 directed downstream (right-hand direction in FIG. 7) of the feed path of the slide fastener chain C.

Figure 8:
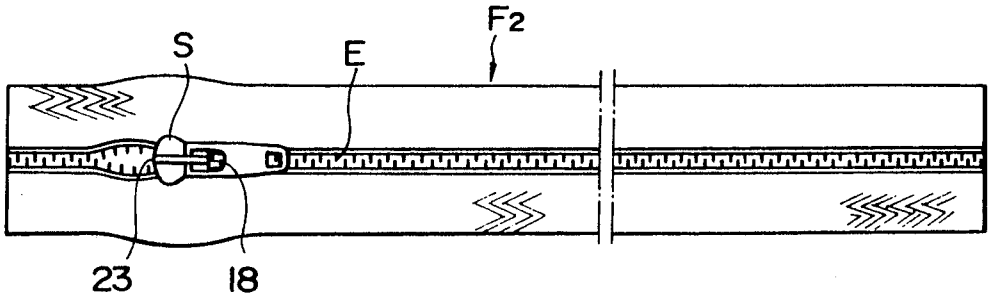

When the slide fastener F2 shown in FIG. 8 is to be produced, the second slider holding unit 6 is raised alone to the uppermost operating position. At the same time, the slider presser 47 and the associated cam plate 22' are lowered to the prespective lowermost operating positions. By moving the gripper unit 2 to feed the slide fastener chain C downstream alon he feed path, a slider S held on the second slider holding unit 6 is threaded onto the slide fastener chain C. After severance of the slide fastener chain C, a slide fastener F2 is produced, with a single slider S mounted on the slide fastener F2 with its head 23 directed upstream (left-hand direction in FIG. 8) of the feed path of the slide fastener chain C.

In order to produce the slide fastener F3 shown in FIG. 9, the first and second slider holding units 5 and 6 are raised in the uppermost operating position to hold a pair of sliders in the feed path of the slide fastener chain C. At the same time, the slider pressers 46 and 47 and the respective cam plates 22 and 22' are lowered to their respective lowermost operating positions. Then the slide fastener chain C which has be gripped at its leading end by the gripper unit 2 at a position adjacent to the chain guide 27 is moved downstream along the feed path by the gripper unit 2, thereby threading the two sliders C successively onto the slide fastener chain C. After the slide fastener chain C is fed by a predetermined distance, the gripper unit 2 is stopped and then the cutter unit 3 is actuated to cut the slide fastener chain C, thus producing a slide fastener F3 of the predertermined lenght. The slide fastener F3 thus produced has two sliders S, S mounted in head-to-head confronting relation, as shown in FIG. 9.

Figure 10:
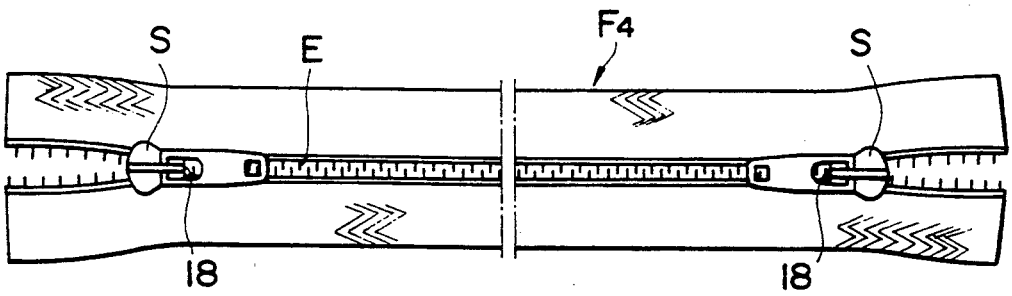

When the slide fastener F4 shown in FIG. 10 is to be produced, the second and third slider holding units 6 and 7 are raised to the uppermost operating position, and the corresponding slider pressers 47, 48 and the associated cam plates 22', 22" are lowered to the lowermost operating position. Two slider S held on the second and third slider holding untis 6, 7 are threaded successively onto the slider fastener chain C as the latter is fed downstream by the gripper unit 2. A slide fastener, which is produced after severance of a predetermined length from the slide fastener chain C, has two sliders S, S mounted in tail-to-tail confronting relation with a pair of interengaged rows of coupling elements E extending therebetween, as shown in FIG. 10.

Figure 11:
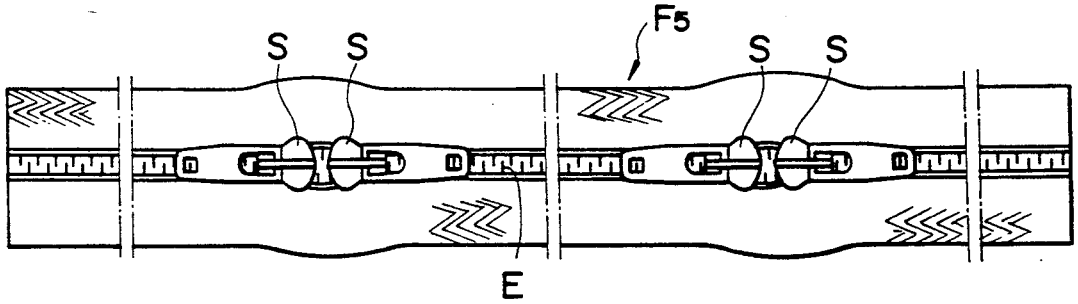
Figure 12:
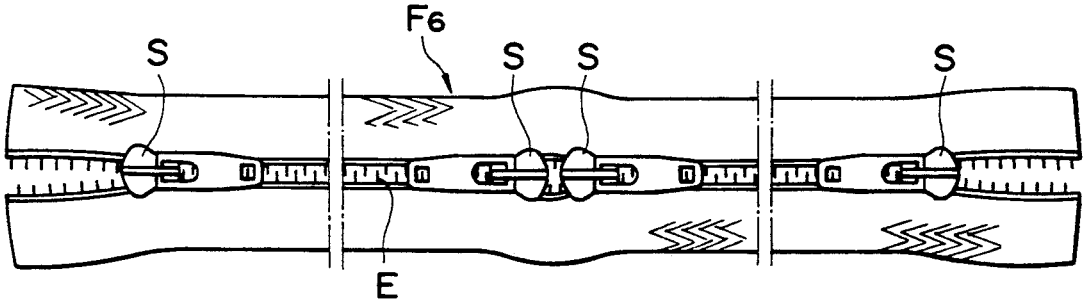

In order to produce the slide fasteners F5 and F6 shown in FIGS. 11 and 12, respectively, at least one slider holding unit, a corresponding slider presser and an associated cam plate are provided additionally. When a slide fastener having five or more sliders is to be produced, a corresponding number of sets of slider holding units, slider pressers and cam plates are should be provided. This is well within the scope of the present invention.

Figure 13:
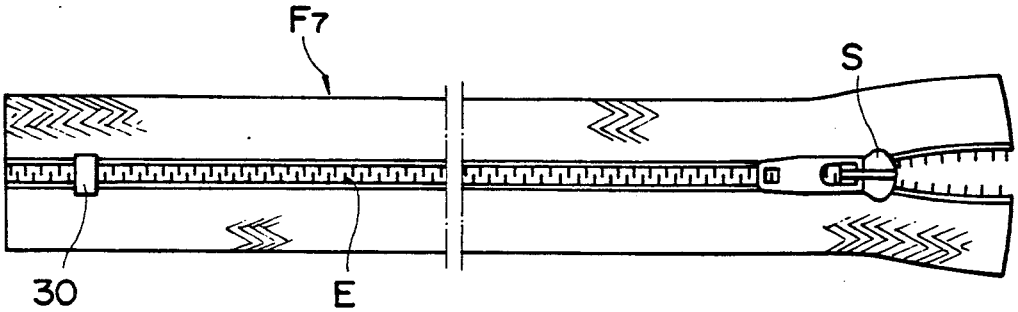

When the slide fasteners F7 shown in FIG. 13 is to be produced, a bottom stop 30 is attached to the slide fastener chain C by actuating the bottom-stop attaching unit 4 after the slide fastener chain C has been fed through a predetermined distance by the gripper unit 2.

Figure 14:
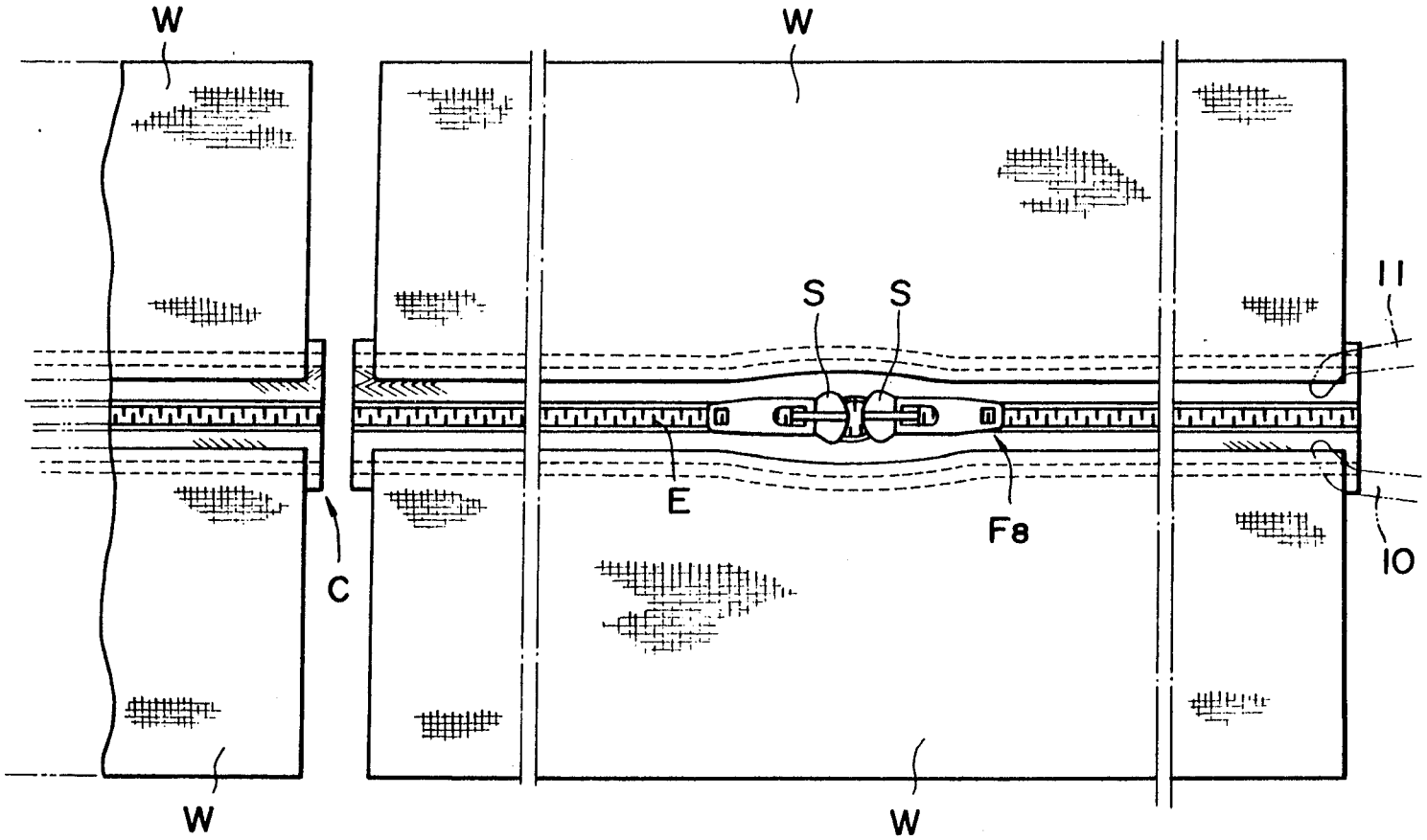

The slide fastener F8 shown in FIG. 14 is identical to the slide fastener F3 shown in FIG. 9 but it is attached by sewing to innerr edgyes of a pair of fabric pieces W, W. To produce the slide fastener F8, a continuous slide fastener chain C with a pair of rows of fabric pieces W, W sewn to outer longitudinal edges of the slide fastener chain C is cut across a space between adjacent pairs of fabric pieces W, W after the sliders S, S are threaded onto the slide fastener chain C.

Although the slide fastener chain C to be processed on the apparatus 1 of this invention is shown with a continuous pair of interengaged rows of coupling elements E, the present invention can be used with a continuous slide fastener chain having a succession of interengaged rows of coupling elements spaced at longitudinal intervals. In the latter case, the slide fastener chain is cut transversely across an element-free space between the adjacent rows of coupling elements. In addition, if slide fasteners to be produced by the apparatus 1 of this invention are limited to those shown in FIGS. 7, 8 and 9, the third slider holding unit 7, the third slider presser 48 and the third cam plate 22" may be omitted.

As described above, the slide fastener manufacturing apparatus of this invention is able to process a continuous slide fastener chain to manufacture slide fasteners of a predetermined length having one or more sliders which are selected at option by the consumers or the apparel makers.

Obviously, various modifications and variations of the present invention are possible in the light of the above teaching. It is therefore to be understood that within the scope of the appended claims the invention may be practiced otherwise than as specifically described.

What is claimed is:

1. An apparatus or manufacturing slide fasteners of a predetermined length from a continuous slide fastener chain, with a selected number of sliders threaded over each individual slide fastener, said apparatus comprising:

(a) a horizontally reciprocable gripper unit for gripping a leading end of the continuous slide fastener chain and feeding the slide fastener chain longitudinally along a feed path;

(b) a cutter unit disposed on said feed path for cutting the slide fastener chain into a succession of slide fasteners of a predetermined length:

(c) a plurality of three or more slider holding units disposed downstream of said cutter unit along the feed path of the slide fastener chain and movable between a first position to hold a corresponding number of sliders in said feed path of the side fastener chain to thread the sliders onto the slide fastener chain from the leading end thereof as the slide fastener chain is fed downstream by said gripper unit, and a second position remote from said first position and (d) each of said slider holding units being operative independent of the operation of another slider holding unit so that at least a selected one of said slider holding units can be disposed in said first position to thread the corresponding slider onto the slide fastener chain.

2. A apparatus according to claim 1 wherein two of said slider holding units are adapted to hold two sliders with a head of one slider confronting to a head of the other slider.

3. An apparatus according to claim 1 wherein two of said slider holding units are adapted to hold two sliders with a tail of one slider confronting to a tail of the other slider.

4. An apparatus for manufacturing slide fasteners of a predetermined length from a continuous slide fastener chain, with a selected number of sliders threaded over each individual slide fastener, said apparatus comprising:

(a) a horizontally reciprocable gripper unit for gripping a leading end of the continuous slide fastener chain and feeding the slide fastener chain longitudinally along a feed path;

(b) a cutter unit disposed on said feed path for cutting the slide fastener chain into a succession of slide fasteners of a predetermined length;

(c) a plurality of slider holding units disposed downstream of said cutter unit along the feed path of the slide fastener chain and movable between a first position to hold a corresponding number of sliders in said feed path of the slide fastener chain to thread the sliders onto the slide fastener chain from the leading end thereof as the slide fastener chain is fed downstream by said gripper unit, and a second position remote from said first position; and (d) each of said slider holding units being operative independent of the operation of another slider holding unit so that at least a selected one of said slider holding units can be disposed in said first position to thread the corresponding slider onto the slide fastener chain; wherein said gripper unit includes a pair of laterally spaced grippers pivotally movable toward and away from each other to spread the slide fastener chain from the leading end thereof, said grippers having a pair of guide pins, respectively, further including a plurality of cam plates corresponding in number to the number of said slider holding units and operatively connected with corresponding ones of the slider holding units, each of said cam plates having a pair of cam surfaces engageable with said guide pins, respectively, to pivot said grippers, said pair of cam surfaces of one of two adjacent ones of said cam plates being profiled such that the leading end of the slide fastener chain being gripped by said gripper unit is progressively spread laterally by said grippers as it is moved through the slider held on one of said slider holding units corresponding to said one cam plate, said pair of cam surfaces of the other one of said two adjacent cam plates being profiled such that the leading end of the slide fastener chain being gripped by said gripper unit is first spread laterally before it is moved into the slider held on an adjacent slider holding unit corresponding to said other cam plate, and then closed progressively by said grippers as it is moved through the slider held on said adjacent slider holding unit.

5. An apparatus according to claim 4 wherein said one cam plate is disposed upstream of said other cam plate.

6. An apparatus acording to claim 4 wherein said other cam plate is disposed upstream of said one cam plate.

7. An apparatus according to claim 4, further including a pair of auxiliary cam plates disposed adjacent to a downstream end of said other cam plate and engageable with said guide pins, respectively, four urging said grippers against said cam surfaces of said other cam plate while the leading end of the slide fastener chain is moved through the slider held on said adjacent slider holding unit.

8. An apparatus according to claim 4, further including a plurality of spring-biased slider pressers disposed in confrontation to the respective slider holding units across said feed path of the slide fastener chain and independently movable toward and away from the confronting slider holding units to resiliently retain the sliders on the confronting slider holding units.

9. An apparatus according to claim 8 wherein said cam plates are integral with said slider pressers, respectively.

10. An apparatus according to claim 9, further including a pair of auxiliary cam plates disposed adjacent to a downsteam end of said other cam plate and engageable with said guide pins, respectively, for urging said grippers against cam surfaces of said other cam plate while the leading end of the slide fastener chain is moved through the slider held on said adjacent slider holding unit.

11. An apparatus according to claim 1, further including a bottom-stop attaching unit disposed between said cutter unit and an upstream one of said slider holding units for attaching a bottom stop to the slide fastener chain.

* * * * *